US006457668B1

(12) United States Patent
Jaschke et al.

(10) Patent No.: US 6,457,668 B1
(45) Date of Patent: Oct. 1, 2002

(54) APPARATUS AND METHOD FOR GUIDING AND CUTTING AN ADVANCING YARN DURING A PACKAGE DOFF

(75) Inventors: Klemens Jaschke, Hückeswagen; Wolfgang Peter Fink, Wuppertal, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/952,500

(22) Filed: Sep. 13, 2001

Related U.S. Application Data

(63) Continuation of application No. PCT/EP00/02060, filed on Mar. 9, 2000.

(30) Foreign Application Priority Data

Mar. 13, 1999 (DE) ..... 199 11 264

(51) Int. Cl.[7] ..... B65H 67/04; B65H 54/28; D01H 13/26

(52) U.S. Cl. ..... 242/473.8; 242/476.4; 242/481; 242/4; 57/284

(58) Field of Search ..... 242/473.8, 475.7, 242/476.3, 476.4, 476.5, 481.4; 57/284, 290

(56) References Cited

U.S. PATENT DOCUMENTS

| | | | | | |
|---|---|---|---|---|---|
| 3,899,140 | A | * | 8/1975 | Gleyze | 242/476.4 |
| 3,938,749 | A | * | 2/1976 | Gleyze | 242/473.8 |
| 4,022,389 | A | * | 5/1977 | Slavik et al. | 242/476.4 |
| 4,948,057 | A | | 8/1990 | Greis | |
| 5,005,776 | A | | 4/1991 | Schwarz | |
| 5,107,668 | A | | 4/1992 | Dammann | |
| 5,924,272 | A | * | 7/1999 | Jaschke et al. | 57/290 |
| 6,045,081 | A | * | 4/2000 | Oberstrass et al. | 242/473.8 |
| 6,047,536 | A | * | 4/2000 | Naylor et al. | 57/284 |
| 6,189,826 | B1 | * | 2/2001 | Oberstrass | 242/473.8 |
| 6,241,177 | B1 | * | 6/2001 | Schroter et al. | 242/476.4 |
| 6,308,906 | B1 | * | 10/2001 | Pyra et al. | 242/476.4 |
| 6,315,236 | B1 | | 11/2001 | Oberstrass et al. | |

FOREIGN PATENT DOCUMENTS

| | | | |
|---|---|---|---|
| EP | 0 311 827 | B1 | 4/1989 |
| EP | 0403949 | A1 | 12/1990 |
| EP | 000916610 | A2 * | 5/1999 |
| EP | 0 916 612 | A2 | 5/1999 |
| FR | 2 247 906 | A5 | 5/1975 |
| FR | 2 374 245 | A1 | 7/1978 |

* cited by examiner

*Primary Examiner*—Michael R. Mansen
(74) *Attorney, Agent, or Firm*—Alston & Bird LLP

(57) ABSTRACT

An apparatus and method for guiding and cutting a continuously advancing yarn (1) during a package doff in a takeup device. The yarn is guided by means of a yarn guide (18) which is movable substantially parallel to a package or to a new tube (13), which is driven by a drive roll (29). Downstream of the yarn guide (18), a deflection device (2) and a suction device (37) are arranged, with the suction device comprising a pneumatic vacuum connection (46) and a cutter (47). The suction device (37) cooperates with a transfer device (42) for purposes of cutting the yarn during a package doff and receiving the loose end of the advancing yarn. To enable a gentle processing of the yarn during the package doff, the yarn guide (18) is arranged in the path of the advancing yarn upstream of the driven tube (13), and a deflection device (2) as well as the suction device (37) are arranged downstream of the driven tube. For catching and winding initial layers on a new tube (13) that is driven by the drive roll (29), the yarn is guided by the deflection device (2) and the yarn guide (18) outside of the range of contact between the tube (13) and the drive roll (29).

20 Claims, 5 Drawing Sheets

APPARATUS AND METHOD FOR GUIDING AND CUTTING AN ADVANCING YARN DURING A PACKAGE DOFF

CROSS REFERENCE TO RELATED APPLICATION

This is a continuation of PCT/EP00/02060, filed Mar. 9, 2000, and designating the U.S.

BACKGROUND OF THE INVENTION

The invention relates to an apparatus and method for guiding and cutting a continuously advancing yarn during a package doff in a takeup device of the general type disclosed in EP 0 311 827 and corresponding U.S. Pat. No. 4,948,057.

In textile machines, for example, a crimped yarn is continuously wound to a package. After the package is fully wound, it is doffed, and to this end, it is necessary to first cut the yarn, so that the full package with the loose yarn end can be exchanged for a new empty tube. During the doff, the yarn end of the continuously advancing yarn is taken in and removed by means of a pneumatic suction device. Once the package doff is completed, the yarn is caught by means of a catching device and initial layers thereof are wound on the new tube.

In the apparatus and method disclosed in the above referenced patents, the yarn is guided by means of a movable yarn guide, after the package is fully wound, outside the winding range to a suction device laterally arranged next to the winding range. After completion of the package doff, and once the new tube is ready for catching, the yarn guide is again pivoted back to the winding range. For the transfer or for catching, a transfer device deflects the yarn between the suction device and the yarn guide, and presents it to the catching device for catching.

The known apparatus and the known method have the disadvantage that at the end of the winding cycle, the loose yarn end lies on the fully wound package in an undefined manner, which makes it difficult to locate the loose yarn end in further processing.

Furthermore, the deflection of the yarn by the transfer device for catching the yarn leads to considerable loopings, which result, when compared with the winding tension, in greater tension fluctuations in the yarn. Such tension fluctuations may lead to the formation of laps on upstream feed elements.

It is an object of the invention to provide an improved apparatus and a method of the initially described type which ensures a gentlest possible guiding and catching of the yarn during the package doff and when winding initial layers of the yarn.

A further object of the invention is to ensure after cutting the yarn that the loose yarn end lies against the tie-off bead of the full package, and that the advancing yarn is threaded onto the new tube without a significant slack.

SUMMARY OF THE INVENTION

The invention distinguishes itself in that the yarn guide and the suction device are arranged within the winding range at the beginning of the package doff. In this connection, the winding range is the region on the tube, which is covered by the yarn being traversed thereover. This permits cutting the yarn with a relatively small deflection and taking it over by the yarn suction device, so that no substantial yarn tension fluctuations occur during the doffing phase. Preferably, the suction device is stationarily arranged. However, a suction device being made movable substantially parallel to the package offers the possibility of placing the loose yarn end with the tie-off bead in any desired position within the winding range.

A deflection device is provided between the yarn guide and the suction device which permits a high flexibility in the design and construction of the catching device. In addition, the deflection device prevents the yarn advancing to the suction device from being clamped between the surfaces of a new tube and the drive roll. The yarn is transferred without slacking from the full package to a new tube. A further advantage of the invention lies in that for purposes of catching, the yarn is guided on both sides of the catching device, which accomplishes a very high catching reliability.

The yarn guide and the deflection device are positioned relative to each other such that the catching device lies in the path of the advancing yarn between the yarn guide and the deflection device. This permits catching the yarn in the catching device without further auxiliary means solely by the movement of the yarn guide. To this end, the yarn is deflected only in the longitudinal direction parallel to the tube. The further, equidirectional movement of the deflection device makes it additionally possible to minimize the deflection of the yarn.

The takeup device of the present invention, wherein the tube is mounted between two clamping plates arranged on a package holder, and wherein the catching device is provided on one of the clamping plates, permits catching the yarn in a simple manner. To this end, the yarn is guided along an oblique path over the front edge of the clamping plate, so that the yarn automatically engages a catching slot arranged in the front edge of the clamping plate. In addition, the arrangement of the yarn guide, deflection device, and catching device is so advantageous that the yarn and the clamping plate perform an equidirectional movement. With that, no slack occurs and, thus, no yarn tension fluctuation in the yarn while being caught.

The deflection device consists of a movable deflecting yarn guide and a controllable drive. The drive moves the deflecting yarn guide from an idle position which is outside the path of the advancing yarn, to a deflecting position. Since the deflection device assumes a guiding of the yarn during the package doff only for a short time, the above construction of the device is very advantageous.

A transfer device guides the yarn in a simple manner from the full package into the suction device, and during the winding of the tie-off bead, as well as at the beginning of the package doff, it is possible to guide the yarn only by means of the yarn guide or only by the yarn guide and the suction device. During this time, the deflecting yarn guide remains in its idle position. No substantial deflections occur, and thus no substantial loopings. Only shortly before the new tube is brought into contact with the drive roll, will the drive activate the deflecting yarn guide for purposes of engaging and deflecting the yarn. Advantageously, the movement of the deflecting yarn guide permits coordinating it with the movement of the yarn guide for guiding the yarn into a catching range in such a manner that, for example, the activation of the drives occurs by a common control device. This permits guiding the yarn in a particularly gentle manner during the further course of the package doff. However, it is also possible to move the deflecting yarn guide in the direction of the tube edge independently of the yarn guide upstream of the driven tube.

In a particularly advantageous development of the apparatus, the deflecting yarn guide moves between its idle position and its deflecting position, and in so doing, the deflecting yarn guide traverses a path of movement transverse to the path of the advancing yarn, so that the deflecting yarn guide is able to engage and deflect the yarn in a reliable manner with its guide edge extending through the plane of the advancing yarn. The advantage of this arrangement lies in that it is possible to present the yarn from a defined position to the catching device for catching. A superposed relative movement between the catching device and the deflecting yarn guide does not exist at this time.

In a particularly advantageous further development of the apparatus, the yarn guide and the suction device are arranged in a transfer plane, so that the loose yarn end can be safely deposited on the tie-off bead of the full package. Furthermore, a simple pivoting movement of the transfer device permits guiding the yarn into the cutter of the suction device. This requires only a deflection in the transfer plane. In so doing, the gripping arm of the transfer device engages the yarn in its path of advance between the previously raised package and the yarn guide. Furthermore, this development has the advantage that when raising the package from the drive roll, the transfer device keeps the yarn safely guided in the yarn guide. The transfer plane is formed preferably within the winding range of the package and perpendicular to the axis of the winding tube and includes the tie-off wind of the package.

A vacuum connection and a cutter of the suction device are arranged in the transfer plane one following the other. This ensures that the pneumatic vacuum connection already engages the yarn before its entry into the cutter. Thus, after being cut in the cutter, the end of the advancing yarn is safely received and removed. To this end, the cutter preferably comprises a cutting blade, which cooperates with the gripping arm of the transfer device such that the cutting blade cuts the yarn clean and fast.

To guide the advancing yarn safely into the opening of the vacuum connection, the vacuum connection includes a suction opening which is slotted in the direction of the advancing yarn, and which is arranged in alignment with a cutting blade of the cutter.

In the previously described operations for doffing a package, for catching, and for winding the yarn, it is presumed that at the beginning of the package doff, the yarn is guided by an auxiliary means on a traversing yarn guide and subsequently taken over by a separate traversing yarn guide. In this connection, the yarn guide is provided preferably with a drive, which moves the yarn guide in the longitudinal direction parallel to the tube, and performs the movement of the yarn guide independently of the direction at a variable speed. In this instance, it would be possible to design and construct the drive, for example, as a linear drive.

In a very advantageous further development of the invention, the yarn guide is designed and constructed as the traversing yarn guide of a yarn traversing device. To this end, the traversing yarn guide is able to guide the yarn outside and inside the winding range in the longitudinal direction parallel to the tube. This construction has the advantage that it does not require an additional control unit for controlling the yarn traversing device. All operations during the package doff and during the catching are controlled via a controller of the yarn traversing device.

After the yarn has been caught, and after initial layers thereof have been wound on the tube, the actual winding cycle starts, i.e. the winding of the package. After the package is fully wound, the yarn is taken over by the suction device to initiate the package doff. To this end, the traversing yarn guide that guides the yarn, stops in the transfer plane. A tie-off bead is first wound on the full package, the latter having previously been raised from the drive roll. Subsequently, the transfer device guides the yarn into the suction device. Once the package has been doffed, and the empty tube is held between the clamping plates, the threadup of the yarn starts. Before the new tube is placed onto the drive roll, the traversing yarn guide and the deflection device guide the yarn out of the region of contact between the tube and the drive roll, i.e., axially beyond the end of the drive roll. The tube is placed onto the drive roll and accelerated to a rotational speed, which is required for the threadup. As soon as the rotational speed is reached, the drive of the traversing yarn guide is activated, and the traversing yarn guide guides the yarn into a catching position, in which the yarn obliquely advances over a catching plane of the catching device, for example, a front edge of the clamping plate.

The method of the present invention distinguishes itself in particular by a rapid and precise package doff. In particular, as a result of guiding the yarn upstream and downstream of the catching device, it is possible to position the yarn very accurately, so that the catching device engages the yarn reliably and without a substantial slack.

The yarn guide may be guided with the yarn to a catching position outside the winding range, so that the yarn crosses with its partial length between the yarn guide and the deflection device a catching plane of the catching device. Alternatively, for catching the yarn, the deflection device may be guided with the yarn to a catching position, so that the yarn crosses the catching plane of the catching device. These two very advantageous variants of the method permit a great freedom of design for the catching device. In addition, they make it possible to avoid unnecessary loopings of the yarn.

The use of the apparatus according to the invention in a false twist texturing machine is especially advantageous. Such machines typically comprise a plurality of side by side processing stations, with each station including means for advancing a continuous yarn serially along a heating chamber, a cooling chamber, a false twist imparting member for imparting false twist to the advancing yarn, and to a winding apparatus. Thus such machines include a plurality of winding apparatuses, which perform, without manual operation, a package doff each time after a package is wound. By being equipped with the apparatus of the present invention, the false twist texturing machine is provided with the previously described advantages.

BRIEF DESCRIPTION OF THE DRAWINGS

In the following, both the apparatus and the method of the present invention are described in greater detail by way of some embodiments with reference to the attached drawings, in which.

DETAILED DESCRIPTION OF THE PREFERRED EMBODIMENTS

Figure 1:
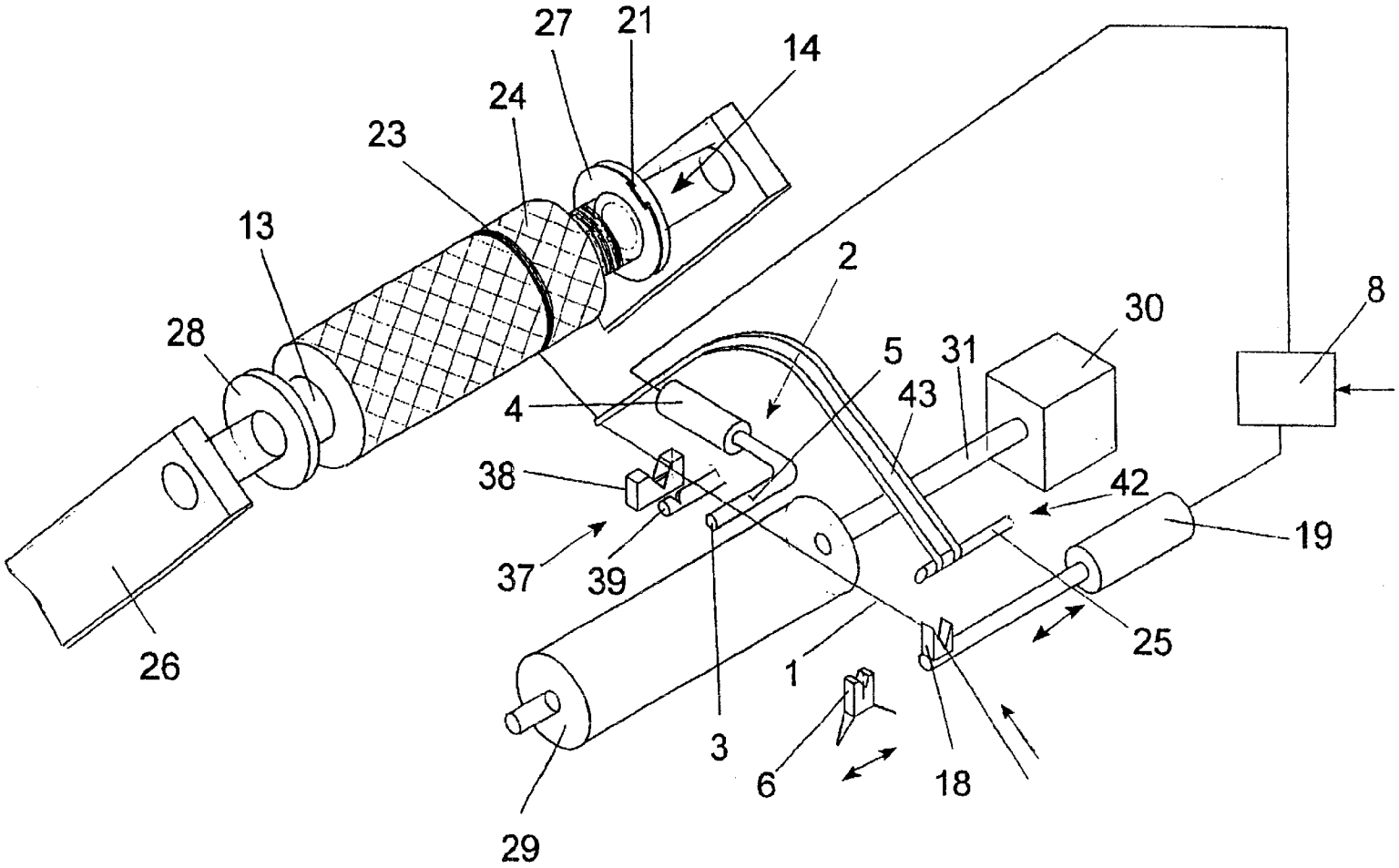
FIG. 1 is a schematic view of a first embodiment of an apparatus according to the invention during a package doff.
Figure 2:
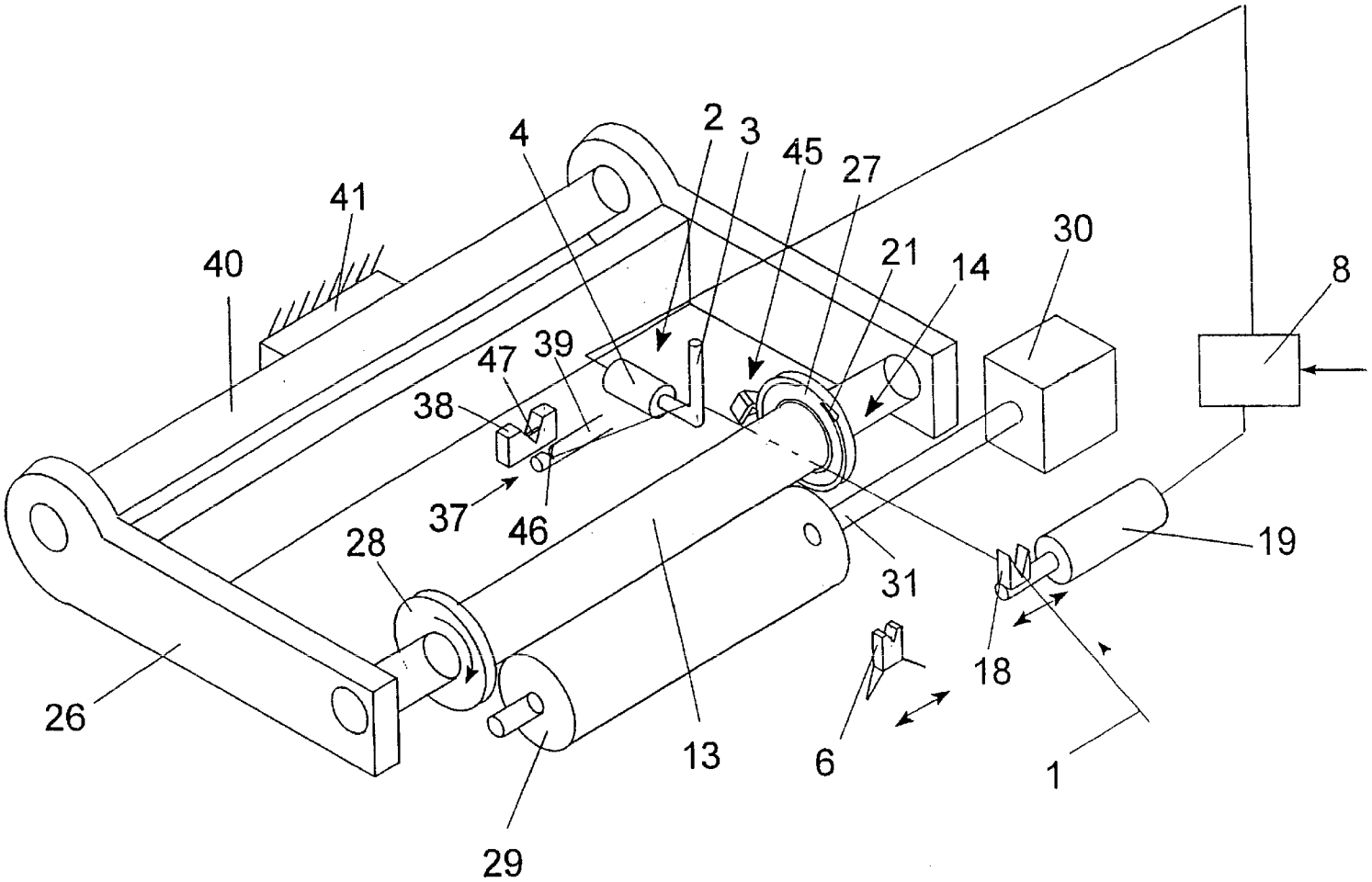
FIG. 2 is a schematic view of the apparatus of FIG. 1 while the yarn is being caught.

FIGS. 1 and 2 illustrate a first embodiment of an apparatus according to the invention within a takeup device, as may be used in particular in a texturing machine. Therefore, the following description will apply to FIGS. 1 and 2, unless otherwise specified.

The takeup device comprises a pivotable package holder 26, which is supported on a pivot axle 40. The pivot axle 40 is mounted to a machine frame 41. The free ends of the fork-shaped package holder 26 rotatably mount two clamping plates 27 and 28 in facing relationship. Supported between the clamping plates 27 and 28 is a tube 13 for receiving a package. To this end, each of the clamping plates 27 and 28 includes a centering extension, which extends in part into the tube end, thereby centering tube 13 between the clamping plates 27 and 28. A drive roll 29 lies against the surface of tube 13. The drive roll 29 is mounted on a drive shaft 31, which connects at its one end to a drive roll motor 30. The drive roll motor 30 drives drive roll 29 at a substantially constant speed. By way of friction, the drive roll 29 accelerates tube 13 to a winding speed, so that a yarn 1 is wound to a package on tube 13. To this end, a traversing yarn guide 6 is arranged in the path of the advancing yarn upstream of drive roll 29. The traversing yarn guide connects to a traverse drive, which drives the traversing yarn guide 6 for oscillating movement within the winding range. The traverse drive may be formed, for example, by a cross-spiraled roll or a belt drive.

Arranged between traversing yarn guide 6 and tube 13 is a movable yarn guide 18. The yarn guide 18 connects to a drive 19, which reciprocates the yarn guide 18 in a plane parallel to tube 13 such that the yarn guide 18 can be positioned both inside and outside the winding range. The drive 19 connects to a controller 8.

The controller 8 is likewise used for activating a deflection device 2. The deflection device 2 is arranged on the side of drive roll 29 or a tube 13 contacting the drive roll opposite to yarn guide 18. The deflection device includes a drive 4, which connects to controller 8. The drive 4 connects to a deflecting yarn guide 3. The deflecting yarn guide 3 is formed by an L-shaped bar. One leg of deflecting yarn guide 3 connects to drive 4, which exerts, when activated, a rotational movement on deflecting yarn guide 3. The free leg of deflecting yarn guide 3 includes a guide edge 5, which is adapted for pivoting from an idle position to an operating position by the rotation of deflecting yarn guide 3. In so doing, the deflecting yarn guide 3 passes through a path of movement, which crosses the path of a yarn 1 entering a suction device 37. FIG. 1 illustrates the deflection device 2 with deflecting yarn guide 3 in its idle position. FIG. 2 shows the deflection device 2 with deflecting yarn guide 3 in its operating position.

The suction device 37 is arranged on the side of tube 13 or drive 29 opposite to the yarn traversing device. The suction device 37 consists of a cutter 38 and a vacuum connection 39. The vacuum connection 39 extends between cutter 38 and tube 13. It possesses a slotted suction opening 46, which is arranged in alignment with a cutting blade 47 of cutter 38.

In the situation shown in FIG. 1, a package doff in the takeup device is imminent. To initiate the package doff, the drive 19 in the winding range positions yarn guide 18 in a transfer plane. At the same time, an auxiliary device not described in greater detail causes the yarn 1 to leave traversing yarn guide 6 and enter yarn guide 18. The auxiliary device may be realized in a simple manner as a ramp, which is introduced into the winding range parallel to the movement of traversing yarn guide 6. With that, it would be possible to remove the yarn 1 automatically from traversing yarn guide 6. Advantageously, the ramp would be coupled with yarn guide 18, so that the yarn sliding on the ramp automatically engages the guide groove of yarn guide 18.

While the yarn guide 18 is positioned in the transfer plane, a tie-off wind is wound on package 24 in the form of a bead. To perform the package doff, the package holder 26 is pivoted in the takeup unit such that the package separates itself from the surface of drive roll 29. With that, the package 24 is no longer actively driven. The yarn 1 continues to be wound as a tie-off bead 23. At this time, a transfer device 42 lateral of the winding range is activated. The transfer device 42 includes a gripping arm 43, which extends with a free end through the transfer plane. The gripping arm 43 is pivotably supported on a pivot axle 25, and moved via a drive not shown parallel to the transfer plane. The gripping arm 43 is dimensioned such that the free end of gripping arm 43 engages the yarn between yarn guide 18 and package 24 and guides it in the transfer plane to suction device 37. The suction device 37 extends within the path of movement, which is described by the free end of gripping arm 43. This causes the yarn 1 to engage the cutter 38, where it is cut by cutting blade 47. Shortly before or simultaneously, the yarn 1 enters the slotted suction opening 46 of vacuum connection 39. Thus, the end of the advancing yarn is removed by suction directly after being cut. The loose yarn end of the package is deposited on tie-off bead 23 by the decelerating package 24. After cutting-the yarn 1, the transfer device 42 is returned to its initial position. During this phase, the deflection device 2 remains in its idle position, so that the deflecting yarn guide 3 has no contact with the yarn.

In the situation shown in FIG. 2, a package doff has already occurred, and the continuously advancing yarn is guided by suction device 37 and yarn guide 18. For the sake of clarity, the illustration of the transfer device was omitted in FIG. 2.

A suction stream continuously removes yarn 1 through suction opening 46 of vacuum connection 39. The package 24 was replaced with a new empty tube, which is driven by drive roll 29. To thread the yarn on empty tube 13 for winding it, the yarn 1 is guided to the suction device 37 by deflection device 2 and yarn guide 18. The yarn guide 18 is moved by drive 19 to a position outside of the winding range. Shortly before or simultaneously, the drive 4 of deflection device 2 is activated via controller 8. Subsequently, the deflecting yarn guide 3 is pivoted out of its idle position, and enters with its guide edge 5 the path of yarn 1. The guide edge 5 of deflecting yarn guide 3 engages the yarn 1 and deflects it. After the deflecting yarn guide 3 has reached its operating position, the yarn 1 slides along the guide edge 5 of deflecting yarn guide 3 until a contact is made, so that the yarn 1 is guided in a deflected position. The advancing yarn 1 is guided by yarn guide 18 and deflection device 2 outside of the winding range. From the deflection device 2, the yarn 1 continues to enter suction device 37, and is continuously removed.

The new tube 13 is now brought into contact with drive roll 29. The circumferential contact between drive roll 29 and tube 13 causes the tube to be accelerated to a winding speed, which is predetermined by drive roll 29. As soon as the winding speed is reached, the yarn guide 18 is moved to a catching position. This catching position of yarn guide 18 is selected such that the yarn 1 obliquely advances over the front edge of clamping plate 27, which faces the tube. Once the tube 13 has reached the winding speed, and a catching groove 21 occupies a position that is required for a reliable engagement, the yarn 1 is caught by catching device 14 in clamping plate 27.

Once the yarn 1 is caught by catching device 14, the yarn is cut by a cutter 45 arranged between deflection device 2 and clamping plate 27. After catching the yarn, drive 19 deflects yarn guide 18 for winding a reserve wind on the tube. To this end, the yarn guide 18 is moved in the direction toward the tube center. After winding the reserve wind, the yarn 1 is transferred to traversing yarn guide 6. To this end, one could also use an auxiliary device, which is constructed as a ramp. At his point, the takeup device starts a new winding cycle. The deflecting yarn guide returns to its idle position.

Figure 3:
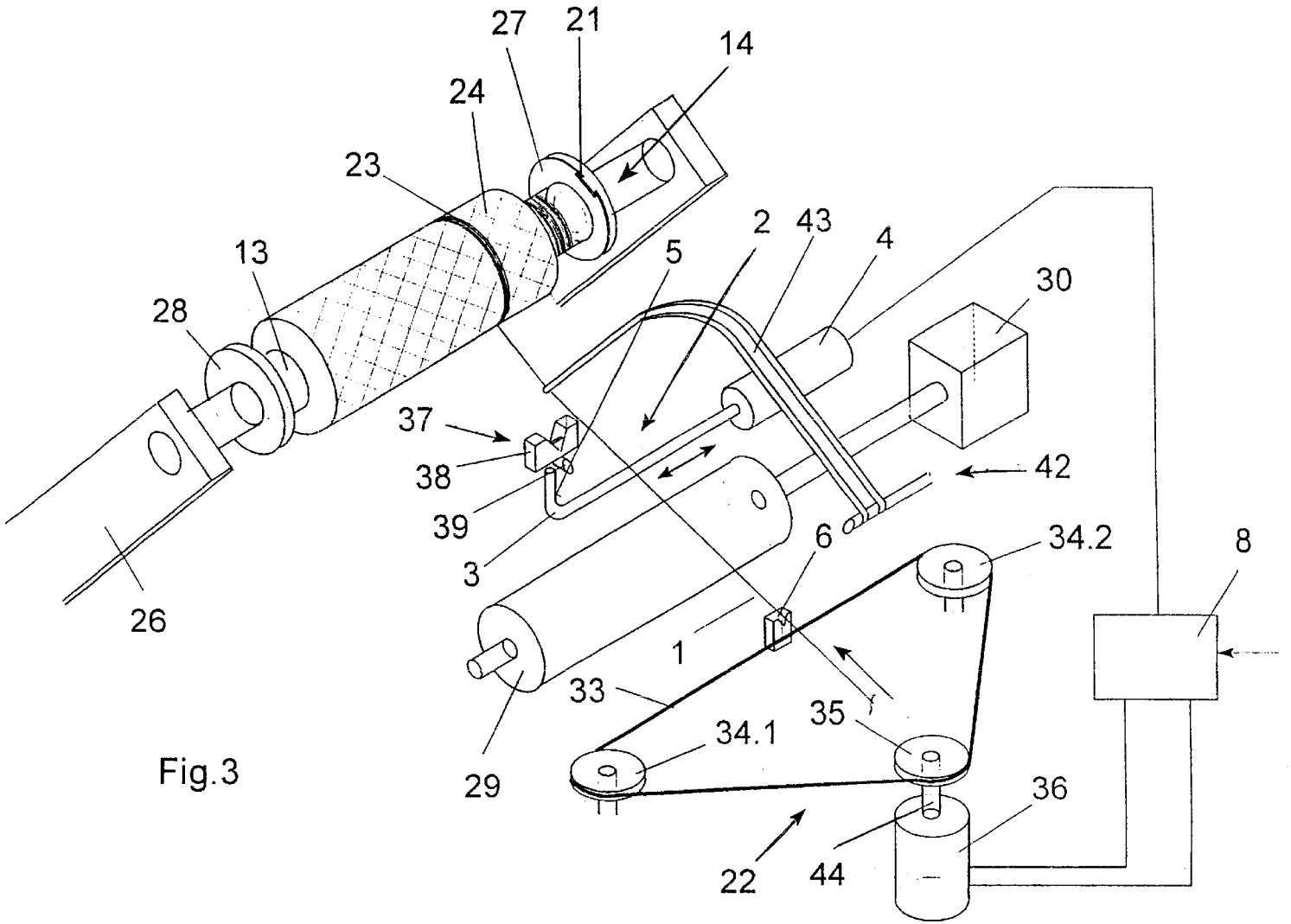
FIG. 3 is a schematic view of a further embodiment of the apparatus according to the invention.
Figure 4:
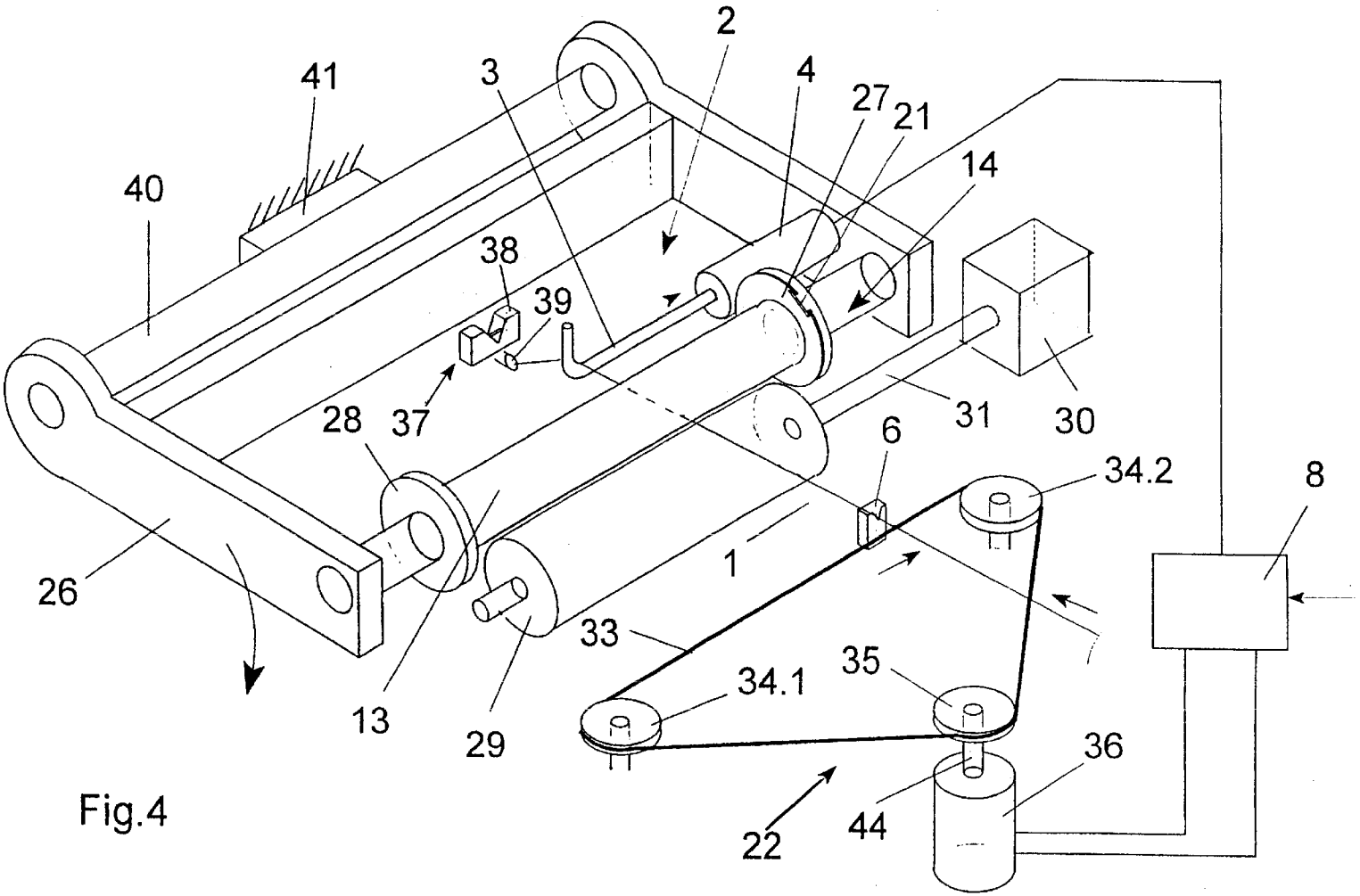
FIG. 4 is a schematic view of the device of FIG. 3 while the yarn is being caught.

FIGS. 3 and 4 illustrate a further embodiment of a device according to the invention, as may be used in a takeup device of a texturing machine. In this embodiment, the yarn guide 6 guides the yarn 1 for doffing the package, for catching, and for winding the yarn. Since the construction of the takeup device essentially differs from the takeup device shown in FIG. 1 only by the yarn traversing device, components of like function are provided with identical numerals. To this extent the description of FIGS. 1 and 2 is herewith incorporated by reference.

A yarn traversing device 22 is constructed as a so-called belt-type yarn traversing system. In this yarn traversing system, an endless belt 33 mounts a traversing yarn guide 6. The belt 33 extends between two deflection pulleys 34.1 and 34.2 parallel to tube 13. In the plane of the belt, parallel to deflection pulleys 34.1 and 34.2, a drive pulley 35 is arranged, which is partially looped by the belt. The drive pulley 35 is mounted on a drive shaft 44 of an electric motor 36. The electric motor 36 drives the pulley 35 in an oscillating movement, so that the traversing yarn guide 6 is reciprocated in the region between deflection pulleys 34.1 and 34.2. The electric motor is activatable via controller 8. The controller 8 also connects to deflection device 2.

In the present embodiment, the deflection device 2 is formed substantially by a deflecting yarn guide 3 extending parallel to the drive roll. To this end, the deflecting yarn guide 3 connects to drive 4. The drive 4 could be designed and constructed, for example, as a cylinder-piston unit. The yarn deflection device includes a guide edge 5, which extends through the plane of a yarn 1 advancing into the suction device 37. By activating drive 4 via controller 8, it is possible to guide deflecting yarn guide 3 with guide edge 5 in such a manner that it engages and deflects a yarn 1 entering the suction device 37.

FIGS. 3 and 4 show the takeup device in different operating positions. FIG. 3 shows the takeup device at the end of a winding cycle. After a package 24 is fully wound, the traversing yarn guide 6 is positioned in a transfer plane. The traversing yarn guide 6 remains in this transfer plane. At this point, a tie-off bead 23 is produced on package 24. At the same time, the package holder 26 with package 24 pivots out of its operating position. A transfer device 42 now becomes active, in that a gripping arm 43 enters the path of the yarn advancing between the full package 24 and traversing yarn guide 6. The gripping arm 43 pivots from an idle position to a transfer position. In so doing, it engages yarn 1 and guides it in the transfer position to suction device 37. The yarn is then cut in cutter 38 and taken in by vacuum connection 39. The loose yarn end is deposited on the package in the region of the tie-off bead. During this phase, the deflection device 2 with deflecting yarn guide 3 is in its idle position. It is now possible to replace package 24 with an empty tube. Once package 24 is replaced with a tube, the threadup sequence starts.

FIG. 4 shows the start of the threadup procedure. The continuously advancing yarn is guided by suction device 37 and traversing yarn guide 6. To this end, the yarn end is sucked into an opening of vacuum connection 39. Before placing the new tube 13 on drive roll 29, the controller 8 activates the drive 4 of deflection device 2. The deflecting yarn guide 3 moves out of its idle position. In so doing, the guide edge 5 engages yarn 1. The deflection guide 3 moves the yarn 1 in contact with guide edge 5 to a deflected position. The traversing yarn guide 6 is likewise moved in the direction of clamping plate 27 outside the winding range. As soon as the yarn 1 is guided by traversing yarn guide 6 and deflecting yarn guide 3 out of the region of contact between tube 13 and drive roll 29, the tube 13 is brought into circumferential contact with drive roll 29. The tube 13 is driven by drive roll 29 in circumferential contact therewith to a winding speed that is predetermined by the drive roll. After the tube 13 has reached the winding speed, the controller 8 activates electric motor 36 such that it moves traversing yarn guide 6 to the catching position. The yarn 1 now crosses the catching plane of catching device 14, so that it is caught by catching groove 21. The yarn 1 is caught with catching groove 21 and cut with a cutting blade integrated in the catching device or clamping plate 27. A clamping plate of this type is known, for example, from EP 0 403 949, which is herewith incorporated by reference.

For purposes of guiding yarn 1 to the catching device, it is possible to assist the movement of traversing yarn guide 6 by deflecting yarn guide 3. It is also possible that traversing yarn guide 6 remains in its position outside of the winding range, and that for catching yarn 1 by catching device 21, the deflecting yarn guide 3 moves yarn 1 to a catching position. In this instance, the movements of traversing yarn guide 6 and deflecting yarn guide 3 are coordinated by controller 8.

After the catching step, the traversing yarn guide 6 is moved from its catching position to the winding range. In this process, the yarn 1 is wound to a reserve wind on tube 13 outside the winding range. In this connection, it would also be possible to form the yarn reserve wind by a traversing yarn guide 6 remaining in one position. In this instance, the yarn reserve wind comprises a plurality of parallel winds. However, it is also possible to move the traversing yarn guide 6 to the winding range at a speed that is determined by electric motor 36, so that side-by-side winds are produced in the yarn reserve wind. As soon as the yarn guide reaches the winding range, the winding cycle will start. The yarn traversing device 22 will then drive traversing yarn guide 6 for oscillating movement within the winding range. A pivoting movement of package holder 26 enables an increasing diameter of package 24. To this end, the package holder 26 comprises biasing means, which generate on the one hand a contact pressure between package 24 and drive roll 29, as is required for driving the package, and which enable on the other hand a pivoting movement of package holder 26.

Figure 5:
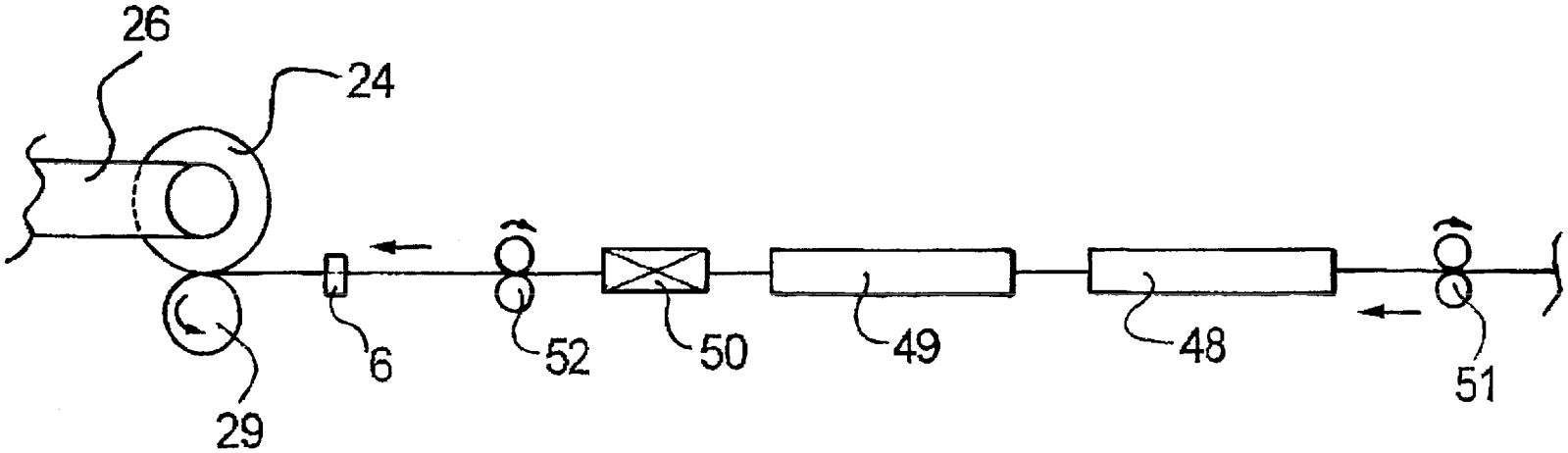
FIG. 5 is a schematic illustration of a yarn false twist texturing machine which embodies the invention.

The winding apparatus of the present invention may be used as part of a false twist texturing machine as illustrated schematically in FIG. 5. More particularly, the false twist texturing machine comprises means 51, 52 for advancing a continuous yarn serially along a heating chamber 48, a cooling chamber 49, a false twist imparting member 50, and to the winding apparatus which includes a yarn traverse 6, a package holder 26, a package 24, and a drive roll 29 as described above.

What is claimed is:

1. An apparatus for winding a continuously advancing yarn to form the same into wound packages, comprising a tube mounting device for rotatably mounting a bobbin tube for rotation about its axis, a drive roll for rotating the mounted bobbin tube about its axis, said tube mounting device and drive roll being mounted for relative movement such that the mounted bobbin tube is moveable between an operative position in contact with the drive roll and so as to define a range of contact therebetween, and a withdrawn position separated from the drive roll, a yarn guide mounted upstream of the drive roll for selective movement by a drive in a direction substantially parallel to the axis of the mounted bobbin tube, a suction device mounted downstream of the mounted bobbin tube and comprising a suction connection and a yarn cutter, a yarn transfer device for selectively guiding the advancing yarn to the suction device so as to cut the yarn and then remove the advancing yarn into the suction connection, and a deflection device provided between the yarn guide and the suction device and downstream of the mounted bobbin tube, said deflection device being moveable between an idle position separated from the advancing yarn and a deflecting position engaging the yarn and such that the yarn can be guided by the deflection device and the yarn guide outside the range of contact between the mounted bobbin tube and the drive roll.

2. The apparatus as defined in claim 1 further comprising a yarn catching device positioned on the tube mounting device so as to lie in the path of the advancing yarn between the yarn guide and the deflection device, when the tube is in said operative position and the deflection device is in said deflecting position.

3. The apparatus as defined in claim 2 wherein the tube mounting device comprises two opposing clamp plates mounted on respective arms of a package holder, and wherein the yarn catching device is formed on one of the clamping plates.

4. The apparatus as defined in claim 3 wherein the deflection device comprises a moveable guide edge and a controllable drive whereby the guide edge is moveable between the idle and deflecting positions.

5. The apparatus as defined in claim 4 wherein the guide edge of the deflection device is configured to move along a direction transverse to the path of the advancing yarn when the yarn is being removed by the suction connection.

6. The apparatus as defined in claim 1 wherein the yarn guide and the suction device may be arranged in a transfer plane, wherein the transfer device includes a gripping arm mounted for pivotal movement parallel to the transfer plane and having a free end which moves through the path of the advancing yarn between the yarn guide and a full package in its withdrawn position, and wherein the suction device is positioned within the radius of movement of the free end of the gripping arm.

7. The apparatus as defined in claim 6 wherein the transfer plane is perpendicular to the axis of the mounted tube and lies within a winding range on the mounted tube.

8. The apparatus as defined in claim 7 wherein the suction connection and the cutter of the suction device are positioned adjacent each other in the transfer plane.

9. The apparatus as defined in claim 8 wherein the cutter comprises a cutting blade, and wherein the suction connection includes a suction opening which is slotted in the direction of the advancing yarn and in alignment with the cutting blade.

10. The apparatus as defined in claim 1 wherein the yarn guide is mounted (1) for traversing movement along said direction within a winding range on the tube, and (2) for movement along said direction to a position outside the winding range, and wherein said drive is configured to selectively reciprocate the yarn guide within the winding range and move the yarn guide to said position outside the winding range.

11. The apparatus as defined in claim 10 wherein said drive is configured such that, upon the package becoming full, the yarn guide is moved to a transfer plane which is perpendicular to the axis of the tube and within the winding range, and wherein said yarn transfer device is configured such that, upon the full package being moved to its withdrawn position, the yarn transfer device is then moved in such manner that the yarn is engaged between the yarn guide and the full package and guided for being cut by the cutter and received in the suction connection.

12. The apparatus as defined in claim 1 wherein said yarn guide is moveable in said direction between positions inside and outside said range of contact between the mounted bobbin tube and the drive roll.

13. The apparatus as defined in claim 12 further comprising a separate traversing yarn guide mounted for traversing movement within a winding range on the tube.

14. A method of guiding and cutting a continuously advancing yarn during the package doff in a package winding operation, comprising the steps of winding the advancing yarn to a package on a bobbin tube driven by a drive roll and so as to define a winding range on the tube, upon the package becoming full, withdrawing the full package from the drive roll, and guiding the advancing yarn to a transfer plane which is within the winding range by a yarn guide which is moved substantially parallel to the package axis and so as to form a tie-off wind, then engaging the yarn by a transfer device to guide the advancing yarn to a suction device and cutting the yarn so that the advancing yarn is received and removed by the suction device, and then replacing the full package with a new bobbin tube and then bringing the new bobbin tube contact with the drive roll to define a range of contact therebetween, and deflecting the yarn between the yarn guide and the full package or the new tube by a deflection device such that the advancing yarn is guided outside the range of contact between the new tube and the drive roll.

15. The method as defined in claim 14 comprising the further steps of moving the new bobbin tube into contact with the drive roll so as to cause the new tube to rotate about its axis, then catching the advancing yarn in a catching device which rotates with the new tube, and then winding the advancing yarn within the winding range upon the new tube.

16. The method as defined in claim 15 wherein the catching step includes guiding the yarn guide to a catching position outside the winding range, so that the yarn crosses with its partial length between the yarn guide and the deflection device a catching plane of the catching device.

17. The method as defined in claim 15 wherein the catching step includes guiding the deflection device to a catching position, so that the yarn crosses with its partial length between the yarn guide and the deflection device a catching plane of the catching device.

18. A yarn false twist texturing machine comprising a heating chamber, a cooling chamber, a false twist imparting member for imparting false twist to an advancing yarn, and a winding apparatus serially arranged along a path of travel, means for advancing a continuous yarn along said path of travel so as to serially engage said heating chamber, said cooling chamber, said false twist imparting member, and then be wound upon said winding apparatus to form a package, said winding apparatus comprising a tube mounting device for rotatably mounting a bobbin tube for rotation about its axis, a drive roll for rotating the mounted bobbin tube about its axis, said tube mounting device and drive roll being mounted for relative movement such that the mounted bobbin tube is moveable between an operative position in contact with the drive roll and so as to define a range of contact therebetween, and a withdrawn position separated from the drive roll, a yarn guide mounted upstream of the drive roll for selective movement by a drive in a direction substantially parallel to the axis of the mounted bobbin tube, a suction device mounted downstream of the mounted bobbin tube and comprising a suction connection and a yarn cutter, a yarn transfer device for selectively guiding the advancing yarn to the suction device so as to cut the yarn and then remove the advancing yarn into the suction connection, and a deflection device provided between the yarn guide and the suction device and downstream of the mounted bobbin tube, said deflection device being moveable between an idle position separated from the advancing yarn and a deflecting position engaging the yarn and such that the yarn can be guided by the deflection device and the yarn guide outside the range of contact between the mounted bobbin tube and the drive roll.

19. The yarn false twist texturing machine as defined in claim 18 wherein the winding apparatus further comprises a yarn catching device positioned on the tube mounting device so as to lie in the path of the advancing yarn between the yarn guide and the deflection device, when the tube is in said operative position and the deflection device is in said deflecting position.

20. The yarn false twist texturing machine as defined in claim 19 wherein the yarn guide and the suction device may be arranged in a transfer plane, wherein the transfer device includes a gripping arm mounted for pivotal movement parallel to the transfer plane and having a free end which moves through the path of the advancing yarn between the yarn guide and a full package in its withdrawn position, and wherein the suction device is positioned within the radius of movement of the free end of the gripping arm.

* * * * *